United States Patent [19]

Sullivan

[11] Patent Number: 4,534,511

[45] Date of Patent: Aug. 13, 1985

[54] FLOCKING APPARATUS

[75] Inventor: Hack A. Sullivan, Hammond, Ind.

[73] Assignee: Sullivan Mfg. & Sales Corp., Hammond, Ind.

[21] Appl. No.: 494,458

[22] Filed: May 13, 1983

[51] Int. Cl.[3] ..... B05B 7/14

[52] U.S. Cl. ..... 239/336; 239/306; 239/420; 239/590

[58] Field of Search ..... 239/303–307, 239/325, 336, 420, 422, 589, 590, 593; 239/335, 461, 601, 124

[56] References Cited

U.S. PATENT DOCUMENTS

| | | | |
|---|---|---|---|
| 1,936,997 | 11/1933 | String | 239/336 X |
| 2,255,189 | 9/1941 | Robinson et al. | 239/422 X |
| 3,185,396 | 5/1965 | Black | 239/336 |
| 3,347,469 | 10/1967 | Ross et al. | 239/336 X |
| 3,403,695 | 10/1968 | Hopkins | 239/335 X |
| 3,844,485 | 10/1974 | Waggoner | 239/420 |
| 3,873,023 | 3/1975 | Moss et al. | 239/336 X |
| 3,891,149 | 6/1975 | Rendemonti | 239/304 X |

*Primary Examiner*—Andres Kashnikow
*Assistant Examiner*—Daniel R. Edelbrock
*Attorney, Agent, or Firm*—Hill, Van Santen, Steadman & Simpson

[57] ABSTRACT

A flocking machine system is described which enables the operator to spray almost dustless by virtue of an adjustable atomized pressurized liquid pattern which encircles a separately issued flock from a handgun applicator. The operator is also able to quickly and conveniently convert to different colored flock spraying by virtue of a portable cart containing jugs of various colored liquid which can be connected to the handgun as a source of pressurized liquid carrier for the flock.

22 Claims, 7 Drawing Figures

FIG. 3
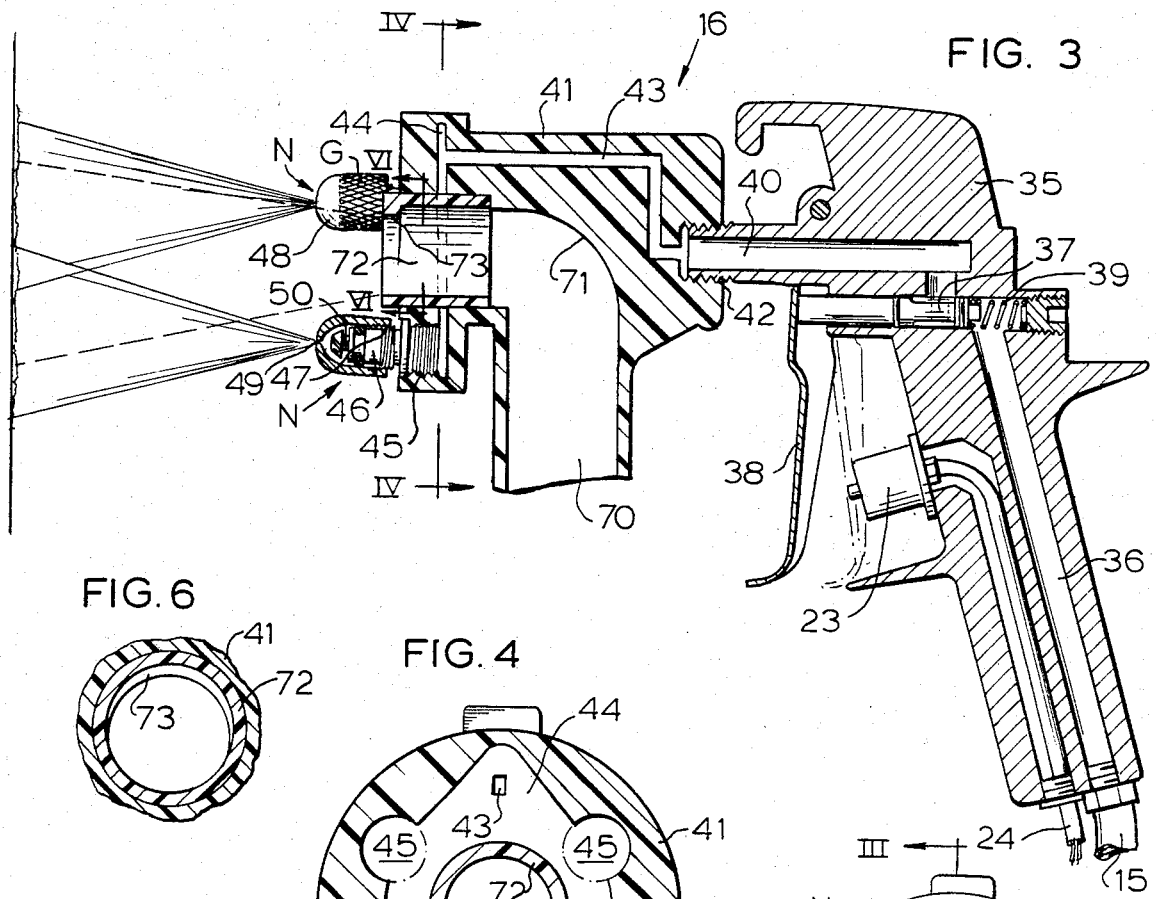
FIG. 6
FIG. 4
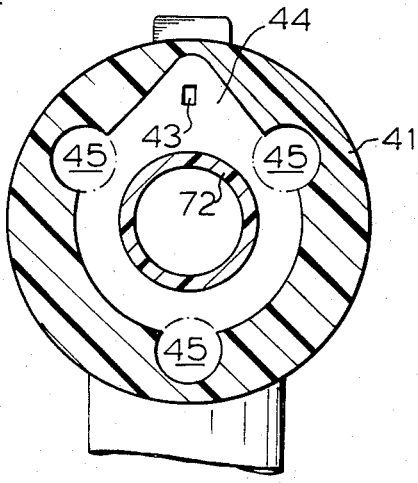
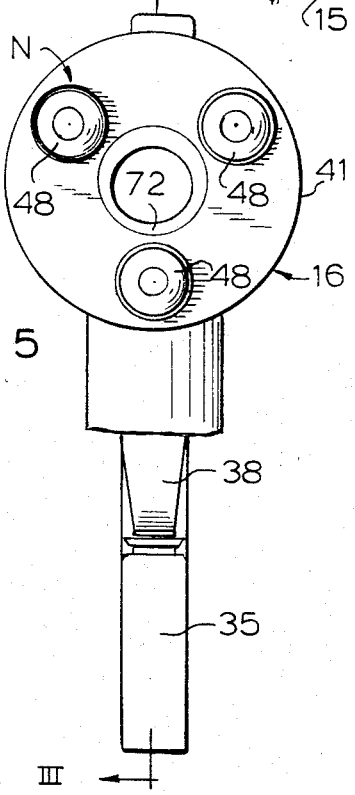
FIG. 5
FIG. 7
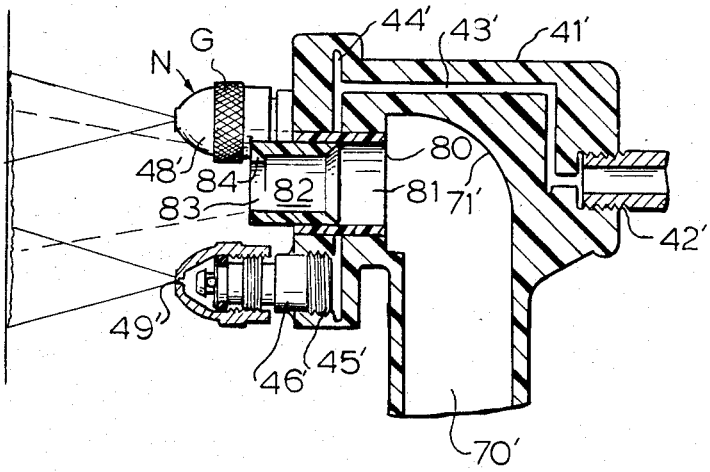

FLOCKING APPARATUS

BACKGROUND OF THE INVENTION

The invention relates to a flocking system, including a unique handgun device, for spraying powdered flock, such as for decorative snow-like affect on Christmas trees.

Flocking machines typically include a handgun applicator to which is connected a pressurized water supply and a supply of flock material. Known flocking handguns have a single outlet nozzle from which issues a spray of flock-bearing water. In these flocking machines, the flock supply is in its powder form which is blown into the handgun by pressurized air. The powder flock then mixes with the water in the handgun and issues forth from the outlet nozzle in a spray. In other known flocking machines, powdered flock is positively pumped into the handgun and issues forth from a discharge opening concentric about a water jet nozzle. These arrangements, however, either unduly saturate the flock or do not enable complete water pick-up of the dry flock.

The liquid-carried flock is sprayed on a target, such as a Christmas tree, whereupon the water evaporates and the target is then effectively coated with a flock foam, such as for creating authentic looking snow.

The present invention relates to a unique flocking machine which enables the operator to switch from color to color without changing flock in the machine in a simple fashion. The inventive flocking machine utilizes a unique spray system in which finely atomized water encircles a separately ejected flock spray, enhancing flock saturation so that the spray is substantially dustless and permitting a more rapid building of artificial snow. The present invention flocking machine may also be used for applying insulation using pulverized material, such as newsprint producing an insulation comparable to foam insulation without the hazards of foam. The inventive spray system also permits application with fairly coarse flock materials, such as popcorn and newsprint, not otherwise usable in known flocking machines.

SUMMARY OF THE INVENTION

A flocking machine system for use in the spray application of powdered or other dry form flock material is provided with a spraygun applicator having separate flock flow and liquid carrier outlet nozzles. The flock nozzle is formed with a relatively enlarged discharge opening centrally of a plurality of circumferentially arranged liquid atomizer nozzles. The liquid atomizer nozzles are preferably of an adjustable type for controlling the spray pattern and issue a plurality of liquid jet sprays which overlap at a point directly outward of the flock nozzle. The flock issues from its nozzle directly into the liquid spray pattern where it is encircled to form an almost dustless flock spray pattern.

The flocking machine may also be provided with a supply of various colored liquids which can be individually controllably conducted to the liquid atomizer nozzles under pressure for a change of flock color. The colored liquids are contained in jugs stacked in a portable carrier and individually connected through flow lines to a common manifold in communication through a pump to the liquid flow passages in the spraygun. The jug flow lines are individually valved such that the operator can readily select the color or color combination liquid.

Other features and advantages of the present invention will become apparent from reading the following detailed description of the preferred embodiments.

BRIEF DESCRIPTION OF THE DRAWING

FIG. 3 is a cross-sectional view taken along the lines III—III of FIG. 5.

FIG. 4 is a fragmentary cross-sectional view taken along the lines of IV—IV of FIG. 3.

FIG. 5 is a front elevational view of the sprayer portion of the flocking machine spraygun.

FIG. 6 is a fragmentary cross-sectional view taken along lines VI—VI of FIG. 3.

FIG. 7 is a fragmentary cross-sectional view of a further embodiment of the sprayer portion of the flocking machine spraygun.

DESCRIPTION OF THE PREFERRED EMBODIMENT

Figure 1:
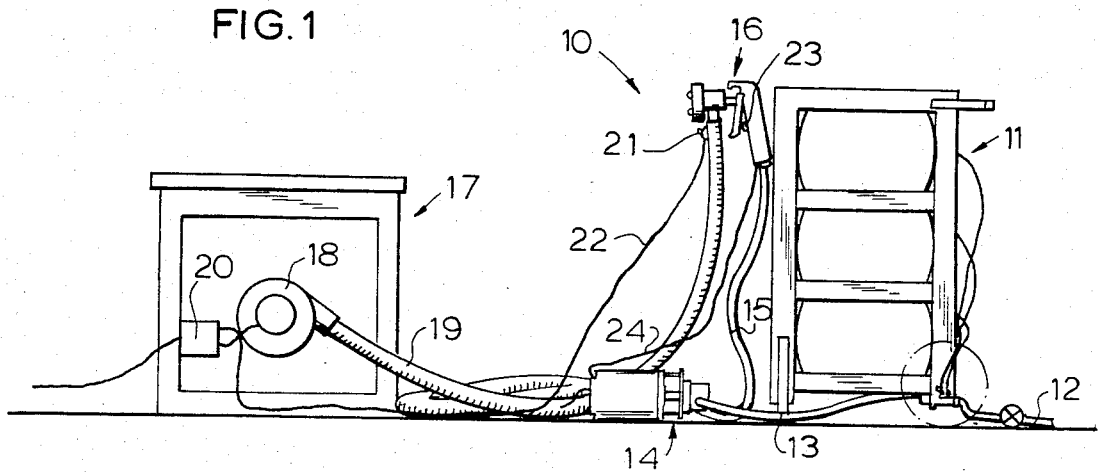
FIG. 1 is a side-elevational view illustrating the flocking machine of the present invention.

FIG. 1 illustrates a flocking machine system 10 constructed in accordance with the present invention. The machine 10 includes an optional color concentrate liquid supply 11 for enabling the flocking machine to issue non-white colored flock spray. Supply lines 12 and 13 serve to connect a source of water, intended as the flock carrier, to a suitable electric motordriven pump 14. The supply lines 12 and 13 communicate with the color concentrate supply 11 in a manner further described below. The supply line 12 contains a valve, which may be a faucet valve or sillcock if city water is used.

The discharge of the pump 14 is conveyed through a flexible line 15 to the handle of a spray handgun applicator 16, further described below.

The machine 10 also utilizes a supply of dry flock material 17 which is conducted by a blower 18 into a flexible hose feedline 19 to the handgun 16. Typical flock material is made up of variable fiber lengths. The blower 18 is operated by an electric motor from a standard control box 20 for turning on and off the motor of the blower 18. An on-off switch 21 is connected at the discharge end of the feedline 19 adjacent the handgun 16 for operating the blower control box 20 through an electrical line 22. A microswitch 23 is disposed on the handle of the spraygun 16 and connected through an electrical line 24 to the electric motor of the pump 14.

Figure 2:
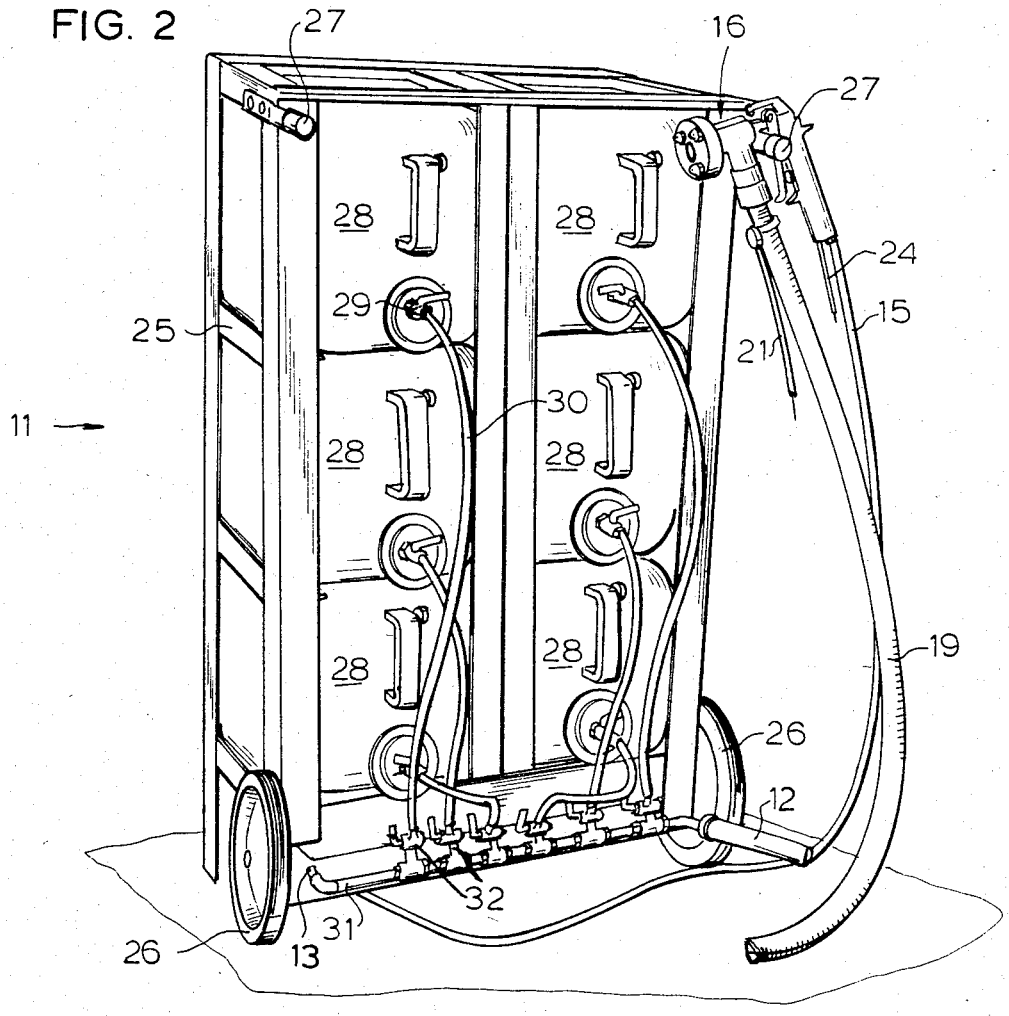
FIG. 2 is a perspective view illustrating the portable color concentrate supply cart and spraygun of the flocking machine of FIG. 1.

FIG. 2 illustrates more particularly the unique features of the color concentrate supply 11. The color concentrate supply 11 is in the form of a portable cart having a box-like support framework 25, supported at one end from below on axled wheels 26 and at the other end by leg rests 27. The framework 25 is suitable for containing a plurality of square-plan profile jugs or containers 28 in a stacked relationship. Each of the jugs 28 contains a sealed outlet at its upper end fitted with an individual controlcock or valve 29 and outlet line 30. The jugs 28 are disposed in the cart framework 25 in upturned fashion such that the outlets all face the horizontal undercarriage of the cart with their individual flow lines 30 exposed through undercarriage openings in the cart.

Each of the jug flow lines 30 is connected to a common manifold 31 disposed at one end of the cart adjacent the wheels 26. The flow lines 30 communicate with the manifold 31 through individual, respective valves or cocks 32. The manifold is connected at one end with the water supply line 12 and at the other end with the supply line 13. Thus, when all the cocks 32 are closed, water is free to flow from supply line 12 through the manifold 31 to supply line 13 and the pump 14 without communication with the contents of the jugs 28.

Each of the jugs 28 contains a color concentrate mixed liquid. The colored liquid in the jugs 28 is preferably non-white and may be all individually separate colors, a common color, or whatever combination of colors the operator requires. By closing the valve in the supply line 12 and opening one or more of the cocks 32 in the color concentrate supply 11, the operator is able to quickly and easily convert from standard white flock spraying to a colored flock spraying with the machine 10 in a manner further described below.

FIGS. 3–6 illustrate a basic format of a nozzle spraygun 16 usable with the flocking machine 10. The spraygun 16 serves as a handgun spray applicator having an elongated handle portion 35 which includes a generally upstanding inlet flow passage 36 connected at its lower end with the outlet of the pressurized liquid flow line 15 and opened or closed at its upper discharge end by a slide or piston valve element 37. The piston valve 37 is manually controlled by a trigger arm 38 which the operator depresses with his finger or fingers to move the piston valve 37 rightward against the bias of a spring 39 to permit flow of liquid from the passage 36 into a further laterally extending passage 40 in the handgun handle.

When the trigger 38 is depressed sufficiently to open communication between the passages 36 and 40 through the piston valve 37, the microswitch 23 is activated by depression (as shown in phantom lines in FIG. 3) to turn on the electric pump 14 causing the liquid flow to pass under pressure through the handle of the handgun and out through the passage 40. The outer tip of the passage 40 is connected to a separate sprayer portion element 41 of the handgun via screwthread attachments 42.

The sprayer portion 41 includes a passageway 43 communicating at its inlet end with the outlet of the handle passage 40. Preferably, the sprayer portion passage 43 is of substantially reduced cross-sectional area relative to the flow section area of the handle passages 36 and 40 for an increased static pressure flow of liquid through the sprayer portion. The passage 43 discharges into a circumferential flow space 44 located within the circular sprayer or outlet face of the sprayer portion 41. Circumferentially spaced about the flow space 44 are a plurality of laterally extending channels 45 which direct the liquid flow to respective spray nozzles N. Each channel 45 screwthread receives an individual respective restrictor nozzle 46. Exposed and longitudinally outward along each restrictor nozzle 46 is mounted for adjustment on a screwthread connection 47 a separate atomizer tip nozzle 48. The atomizer tip nozzles each contain a central atomizer jet opening 49 for issuing pressurized liquid conveyed through the restrictor nozzle 46 and into the atomizer tip 48 through an opening 50 in the atomizer nozzle. Extending circumferentially around the outer surface of each atomizer tip nozzle 48 is a grid surface G enabling the operator to selectively adjust the relative position of the jet opening 49 and the restrictor nozzle outlet 50 to control the spray pattern angles of pressurized liquid.

The spray nozzles N and channels 45 are such that the longitudinal centerline of each nozzle N is angled slightly (approximately 2°–5°) toward a common lateral axis centered among the nozzles N. However, it is preferable that the lowermost nozzle N, such as in the configuration shown in FIGS. 4–5, be canted at a slightly greater angle toward this lateral centerline to compensate for gravity fall of its liquid spray.

Removability of the nozzle tips 48 permits easy cleaning of the spray tips. Their relative movement along the restrictor nozzles 46 makes it possible to adjust the spray patterns anywhere between solid stream and fine mist.

Extending upwardly into the center of the sprayer portion 41 is a flock passageway 70 communicating at its lower end with the discharge of the flock supply hose 19. The flock passageway 70 is formed with an upper end curved portion 71 for directing the flock flow laterally outward from the sprayer portion 41. This curved portion 71 avoids the creation of a sharp corner turn in the passageway 70, which otherwise may cause flock particles to become trapped at the upper end of the passageway and lead to a back build-up partially obstructing the flock flow. Further as a result of the elimination of back clogging at the upper end of the passageway 70 due to the curved construction at portion 71, pulsating in the emitted flock flow is prevented and a more uniform flock issuance occurs, even when the humidity in the spray environment is relatively high.

Extending laterally from the curved portion 71 is a flock emission nozzle 72 communicating with the passageway 70 and disposed substantially centrally of the circumferentially arranged atomizer nozzles N. The emission nozzle 72 is generally in the form of a sleeve, but formed with an eccentrically configured lip 73 protruding radially inward of the flow space and disposed at the outer, exterior edge of the emission nozzle 72. As shown in FIG. 6, the lip protrusion 73 begins at each of the opposed side edges of the emission nozzle sleeve and generally linearly increases in depth to a maximum at the uppermost point on the sleeve hollow circle. The eccentric configuration of the lip 73 serves to prevent channeling of flow out from the upper side of the emission nozzle 72 by causing such upper portion of the flock flow in the emission nozzle to be deflected radially back into the main flock flow emission, the maximum deflection occurring at the point of possible concentrated channeling, ie. the top of the emission nozzle sleeve 72. This dispersal of the upper portion of flock flow through the emission nozzle enables a more uniformly distributed flock emission to exit the sprayer portion 41.

The cross-sectional area of the flock emission nozzle 72 is very much greater than the atomizer jet openings 49, but relatively reduced in comparison to the flow area of the flock passageway 70. In this manner, flock under pressure, by virtue of the control switch 21 being turned on so that the blower 18 is activated, is conducted under pressure into the passageway 70 of the sprayer portion 41 and laterally outward of the handgun through the emission nozzle 72 in a pattern generally linear and central of the pressurized liquid sprays from the atomizer nozzles 48.

The atomizer nozzles 48 issue a plurality of individual spray streams having a spray pattern angle of preferably about 30 degrees. These spray streams overlap at a point substantially centrally of the circumferentially arranged spray nozzles N and laterally outward, but aligned, with the outlet of the flock nozzle opening 72. Accordingly, the pressurized flock issuing from the nozzle 72 is circumferentially engulfed and conveyed by the pressurized liquid spray streams to produce a virtually dustless flock spray. The spray patterns preferably occur as a fine mist of atomized liquid water enabling the flock spray to be virtually dustless. This sprayer arrangement enables the flocking machine 10 to handle relatively coarse grade flock material, such as pulverized popcorn and newsprint, rendering the flocking machine 10 useful for more economical types of flocking methods. It should also be noted that the flocking machine 10, by virtue of the unique sprayer portion arrangement 41, can also be used for applying insulation with a coarse material, such as pulverized newsprint, in a manner which is very comparable to foam insulation without the hazards of foam.

Typical commercial flocking material is white. When a conventional water supply is used to form the atomized spray patterns, white flocking is produced with standard flocking material. The inventive flocking machine 10, however, enables the operator to produce non-white, colored flocking sprays by virtue of the color concentrate supply 11. When a colored flocking spray is desired, the valve in the water supply line 12 is closed and one or more of the cart manifold cocks 32 are opened, depending on which color or color mixture the operator desires, so that colored liquid is pumped into the handgun inlet passage 36 to produce adhesion of color particles on the flock by virtue of the atomized mist engulfment of the liquid spray streams. It will be understood that preferably the jug valve cocks 29 are opened after the jugs 28 have been disposed in the cart 25, thus avoiding dry pumping through the jug flow lines 30 when their respective manifold cocks 32 are opened.

It should also be noted that it may not be necessary to activate the system pump 14 when city water having a pressure greater than sixty psi is tapped for the water supply through line 12, since the handgun arrangement 16 is able, through the use of restricted passageways and atomizer nozzles 48, to convert this pressure into sufficiently atomized spray streams. For example, when pump 14 is a commonly used gear pump, the city water pressure would enable water flow to pass around the gears in the pump and into the flow line 15 up into the handgun 16.

FIG. 7 illustrates a further embodiment 41' of a sprayer portion for the flocking machine handgun 16 in which a different flock emission nozzle construction is used. In all other respects, the sprayer portion 41' is comparable to the sprayer portion 41 described above such that like reference numerals primed are used to generally designate the individual carried over features.

The flock emission nozzle, extending laterally from the curved portion 71' of the passageway 70, is an adjustable two piece arrangement 80 consisting of a fixed cylindrical outer sleeve 81 and a relatively laterally adjustable cylindrical inner sleeve 82. The inner sleeve 82 serves to define the flock emission nozzle opening and is concentrically disposed within the outer sleeve 81, in press fit or the like relation therewith, permitting the inner sleeve 82 to be adjustably position in the lateral direction within the outer sleeve 81. The exit outlet 83 of the inner sleeve nozzle 82 is provided with an eccentrically configured lip portion 84 in the manner of the lip portion 73 described above. The press fit mounting of the inner sleeve nozzle 82 enables the operator to laterally position the flock emission outlet 83 relative to the pressurized liquid spray patterns (also adjustable) as desired to control the efficacy of the mixture and point of entrainment of the atomized liquid streams and the flock.

The emission nozzle 80 of FIG. 7 is an inventive arrangement which enables the flocking machine to be readily used with different types of flock material, such as typical commercial material for flocking and coarse grade material for insulation application. This adjustable nozzle arrangement also further assists the operator in adapting the flocking machine to extraneous conditions, such as humidity and wind, which may necessitate changes in the manner of flock entrainment to obtain an efficacious delivery.

Although various minor modifications may be suggested by those versed in the art, it should be understood that I wish to embody within the scope of the patent warranted hereon all such modifications as reasonably and properly come within the scope of my contribution to the art.

I claim as my invention:

1. An improved flocking machine comprising a handgun having a portion for applying a flock spray, a source of pressurized liquid connected to said handgun, and means for positively feeding dry flock to said handgun, the improvement comprises:

said sprayer portion having a linearly directed flock nozzle for the emission of said dry flock, a plurality of adjustable atomizer nozzles circumferentially disposed about said flock nozzle for respectively directing liquid spray streams in patterns which substantially circumferentially engulf said dry flock emitted from said flock nozzle and which intersect with one another at a point outward and aligned with said flock nozzle, and a lip extending radially into the top of a discharging opening of said flock nozzle and eccentrically disposed between opposed side edges of said flock nozzle along the top of the discharge opening.

2. The improvement of claim 1, wherein each said atomizer nozzle comprises a tip member having a jet opening and a restrictor nozzle portion for delivering pressurized liquid through an outlet into said tip member, said tip member being disposed on said restrictor nozzle covering said outlet for relative longitudinal movement to adjust said respective spray stream.

3. The improvement of claim 1, further comprising a pump means for delivering said pressurized liquid, a feedline connecting said pump to a valved supply of water, a manifold in said feedline, and at least one portable container of colored liquid connected through a respective valve means to said manifold, such that said pump means can optionally be connected to said water supply or said at least one container of colored liquid.

4. The improvement of claim 3, further comprising a portable cart for carrying said manifold and said at least one portable container and respective valve means.

5. The improvement of claim 4, wherein said portable cart contains a plurality of portable containers of various colored liquids, each said portable container being connected through respective valve means to said manifold.

6. The improvement of claim 1, further comprising a pump means for delivering said pressurized liquid and a blower means for feeding said dry flock, said handgun having a switch for activating said blower means and a trigger arm pivotable toward or away from a handgun handle, said trigger arm being biased away from said handle and pivotable toward said handle for engagement with a control valve to open flow of said pressurized liquid to said sprayer portion and with a microswitch to activate said pump means.

7. The improvement of claim 6, wherein said sprayer portion is separable from said handle.

8. The improvement of claim 1, wherein said sprayer portion is formed with a substantially vertical passageway leading to a curved passageway for conducting flock therein, said curved passageway communicating directly with said flock nozzle.

9. The improvement of claim 1, wherein said lip has a maximum radial depth at the uppermost point of the flock nozzle discharge opening.

10. The improvement of claim 1, wherein said flock nozzle comprises an outer sleeve and a concentrically disposed inner sleeve longitudinally movable with respect to said outer sleeve for adjusting the emission pattern of said dry flock.

11. The improvement of claim 10, wherein said inner sleeve has said eccentrically disposed lip extending radially into the discharge opening thereof.

12. The improvement of claim 11, wherein said sprayer portion is formed with a substantially vertical passageway leading to a curved passageway for conducting flock therein, said curved passageway communicating directly with said flock nozzle, and said lip having a maximum radial depth at the uppermost point of the inner sleeve discharge opening.

13. For a handgun applicator for flock spraying, an improved sprayer portion having a linearly directed flock nozzle for emitting a dry flock flow under pressure, and a lip extending radially into the top of a discharge opening of said flock nozzle and eccentrically disposed between opposed side edges of said flock nozzle along the top of the discharge opening reaching a maximum radial depth at the uppermost part of the flock nozzle discharge opening, and a plurality of adjustable atomizer nozzles circumferentially disposed about said flock nozzle for respectively directing pressurized liquid spray streams in patterns which substantially circumferentially engulf said dry flock flow and which intersect with one another at a point outward and aligned with said flock nozzle.

14. The improved sprayer portion of claim 13, wherein each said atomizer nozzle comprises a tip member having a jet opening and a restrictor nozzle portion for delivering pressurized liquid through an outlet into said tip member, said tip member being disposed on said restrictor nozzle covering said outlet for relative longitudinal movement to adjust said respective spray stream.

15. The improved sprayer portion of claim 13, wherein said flock comprises an outer sleeve and a concentrically disposed inner sleeve longitudinally movable with respect to said outer sleeve for adjusting the emission pattern of said dry flock.

16. The improved sprayer portion of claim 13, wherein said sprayer portion is formed with a substantially vertical passageway leading to a curved passageway for conducting flock therein, said curved passageway communicating directly with said flock nozzle.

17. An improved handgun application for flock spraying comprising a handle member and a sprayer portion attached to a lead end of said handle member, said handle member containing a passageway therethrough controlled by a movable valve means normally biased in a closed position for regulating a flow of pressurized liquid and having a trigger arm engageable through pivotable movement with said valve means to move said valve means against the bias into an open position, and said sprayer portion having a linearly directed flock nozzle for the emission of dry flock, a plurality of adjustable atomizer nozzles circumferentially disposed about said flock nozzle for respectively directing liquid spray streams in patterns to substantially circumferentially engulf dry flock emitted from said flock nozzle, channel means therethrough connecting said atomizer nozzles with said passageway, and a lip extending radially into the top of a discharge opening of said flock nozzle and eccentrically disposed between opposed side edges of said flock nozzles along the top of the discharge opening.

18. The improved handgun applicator of claim 17, wherein said flock nozzle comprises an outer sleeve and a concentrically disposed inner sleeve longitudinally movable with respect to said outer sleeve for adjusting the emission pattern of said dry flock.

19. The improved handgun applicator of claim 17, further comprising a depressible microswitch means disposed on said handle member for engagement by said trigger arm when said valve means is moved into an open position.

20. The improved handgun apparatus of claim 17, wherein each said atomizer nozzle comprises a tip member having a jet opening and a restrictor nozzle portion for delivering pressurized liquid through an outlet into said tip member, said tip member being disposed on said restrictor nozzle covering said outlet for relative longitudinal movement to adjust said respective spray stream.

21. The improved handgun apparatus of claim 17, wherein said sprayer portion is formed with a substantially vertical passageway leading to a curved passageway for conducting flock therein, said curved passageway communicating directly with said flock nozzle.

22. The improved handgun apparatus of claim 17, wherein said lip has a maximum radial depth at the uppermost point of the flock nozzle discharge opening.

* * * * *